United States Patent [19]

DeYoung

[11] Patent Number: 4,951,946

[45] Date of Patent: Aug. 28, 1990

[54] PORTABLE FOLDING GAME RAMP

[76] Inventor: Lee DeYoung, 904 Silver Spur Rd., Ste. 688, Rolling Hills Estates, Calif. 90274

[21] Appl. No.: 319,678

[22] Filed: Mar. 7, 1989

[51] Int. Cl.[5] ..... A63B 61/00

[52] U.S. Cl. ..... 273/29 R; 14/2.4; 414/537

[58] Field of Search ..... 273/29 A, 30, 29 R; 105/436; 193/41, 38; 414/537; 14/71.1, 71.5, 71.7, 72.5, 2.4; 114/258

[56] References Cited

U.S. PATENT DOCUMENTS

| | | | |
|---|---|---|---|
| 2,066,724 | 1/1937 | Forsyth | 273/30 |
| 3,830,495 | 8/1974 | Hill | 273/30 |
| 4,621,812 | 11/1986 | Salansky | 273/29 A |

FOREIGN PATENT DOCUMENTS

| | | | |
|---|---|---|---|
| 2519958 | 5/1975 | Fed. Rep. of Germany | 273/29 R |

OTHER PUBLICATIONS

Recreation Mgnt., Jun./Jul. 1974, p. 14.

*Primary Examiner*—Theatrice Brown
*Attorney, Agent, or Firm*—Donald A. Streck

[57] ABSTRACT

A play enhancing game ramp for use in a game wherein opposing players exchange an elastic projectile between each player over a barrier on a playing surface. the preferred ramp for tennis use is employed in sets of three adjacent ramps which each includes a portable base frame, a pair of connected planar ramp sections hinged together and movable between a folded configuration and an unfolded configuration in which the ramp sections form a single ramp lying in a path extending from the predetermined height toward the playing surface, and strut supports connected between the pair of ramp sections and the portable base frame for causing said pair of ramp sections to counterbalance one another. Each of the pair of ramp sections has a top surface which reflects the trajectory of an incident projectile so that it passes over the barrier. The ramp (in alternate embodiments) can also be employed to enhance the play of other games such as badminton and ping pong.

15 Claims, 2 Drawing Sheets

PORTABLE FOLDING GAME RAMP

BACKGROUND OF THE INVENTION

1. Technical Field

The field of the invention is athletic training equipment and the like for games such as tennis.

2. Background Discussion

Competitive games such as tennis, ping pong and badminton employ a net separating two players who propel an elastic projectile back and forth over the net within a bounded area. Enjoyment of such a game is dependent upon the compatibility of the skills of the two opposing players. Accordingly, one of the biggest problems a player faces in arranging such a game is to find another player whose skill level is near his own. A tennis player of intermediate skill can rapidly improve by playing against a tennis player of advanced skill. Unfortunately, the greater the difference between the skill levels of the two players, the more often play is interrupted by the lesser skilled player hitting the ball into the net. The more frequently this happens, the more time is spent retrieving the ball instead of playing the game, until a point is reached at which the two players are simply incompatible.

If it were somehow possible to prevent a ball hit by the less experienced player from hitting the net, then he could play against an advanced player and play more tennis during a given amount of time, instead of retrieving the ball. This would revolutionize the game by making more players compatible and affording less experienced players opportunities to improve by playing against advanced players. It would also improve the process of teaching the game by permitting the teacher or expert to interact with the student in a game setting without losing time in retrieving balls hit to the net by the student. However, the mere presence of the net would seem to rule out such a scenario. It is the purpose of the present invention to overcome this limitation in spite of the presence of the net. The invention provides greater compatibility between players of different skill levels by preventing the ball from being hit into the net by the less skilled player without requiring any alteration of the net or the use of any heavy or unportable equipment.

Accordingly, it is an object of the invention to provide an apparatus for compensating for differences between the skills of two opposing players in a tennis game or the like.

It is a further object of the invention to provide an apparatus which compensates for differences between the skill levels of two opposing players in a tennis game or the like by preventing any balls hit by the lesser skilled player from hitting the net and instead causing the ball to pass over the net so that, at least in many instances, the other player can keep the ball in play.

It is yet a further object of the invention to provide an apparatus which is foldably collapsable, lightweight and readily portable for causing a ball otherwise hit toward the net to instead sail over the net so that the ball has a better chance of remaining in play in a tennis game or the like.

It is still further object of the invention to provide such a foldably collapsable apparatus which is quickly and easily unfolded with the exertion of very little force.

Other objects and benefits of the invention will become apparent from the description which follows hereinafter when taken in conjunction with the drawing figures which accompany it.

SUMMARY OF THE INVENTION

The foregoing objects have been achieved by the play equalizing ramp of the present invention for use in a game wherein opposing players of different degrees of expertese exchange an elastic projectile between the players over a barrier disposed vertically above a playing surface. The play equalizing ramp comprises, projectile deflecting ramp means extending downward from a top edge of the barrier towards the one of the players which is of less expertese and including a reflecting top surface for deflecting the projectile from a trajectory which would carry it into the barrier to a trajectory carrying it over the barrier; and, support means for supporting the ramp means in the position extending downward from the top edge of the barrier towards the one of the players.

The preferred ramp means comprises a plurality of ramp sections hingedly connected to one another at horizontal hinge points whereby the ramp sections can be folded together for storage. Further in the preferred embodiment, the support means comprises, a flat base section mounted on wheels which roll on the playing surface for moving the equalizing ramp between a location adjacent the barrier for use in game play and a storage location, and an upright section carried by the base section; gripping means carried by the base section for gripping portions of the ramp sections; and wherein, the ramp sections are pivotally attached to the upright section for pivoting movement between a playing position with the ramp sections coplanar to form the ramp means extending from the top of the barrier to and resting on the playing surface and a storage position with the ramp sections folded together and with portions of the ramp sections being gripped and retained in the storage position by the gripping means.

The foregoing objects are achieved for use in tennis by a portable folding game ramp as above used in sets of three adjacent ramps. Each preferred ramp includes a portable base frame; a ramp connected to the base frame, the ramp characterized by a surface from which the projectile bounces upon impact therewith and articulating supports connecting the ramp to the base frame whereby the ramp is movable between a compact folded position and an extended position extending from the top of the tennis net along a descending angle toward the playing surface. Each preferred portable folding game ramp further includes wheels supporting the base frame on the playing surface for moving the ramps easily between playing locations and storage locations. Each ramp comprises first and second planar ramp sections with center hinges connecting the ramp sections together along a lateral edge of each of the ramp sections. The articulating supports comprise sleeve assemblies which constrain the center hinge means to move in a generally fixed path with respect to the base frame and articulating struts connected to the base frame for supporting opposing longitudinal edges of each of the ramp sections. The first and second ramp sections rotate in first opposing directions about the center hinges toward the folded configuration as the center hinges move in a first direction along the path and rotate in second opposing directions about the center hinges toward the extended configuration as the center hinges move in the opposite direction.

The preferred portable folding game ramp further comprises a third ramp section and a rear hinge connecting it to the second ramp section. The sleeve assemblies comprise a pair of vertical center struts connected to the base frame and a pair of sleeves slidably mounted on respective ones of the center struts, the sleeves being connected to the center hinge means near opposing ends thereof. The articulating struts comprise a pair of forward struts and forward hinges connecting one end of each of the forward struts to the base frame at opposite sides thereof and connecting the other ends of the forward struts to the longitudinal edges of the first ramp section. The articulating struts further include a pair of middle struts and middle hinges connecting one end of each of the middle struts to the base frame at opposite sides thereof and connecting the other ends of the middle struts to the longitudinal edges of the second ramp section.

One advantage of the invention is that the ramp sections are counterbalanced so as to be easily folded or unfolded.

DESCRIPTION OF THE DRAWINGS

Preferred embodiments of the invention are described below with reference to the accompanying drawings, of which.

Figures 1, 2:
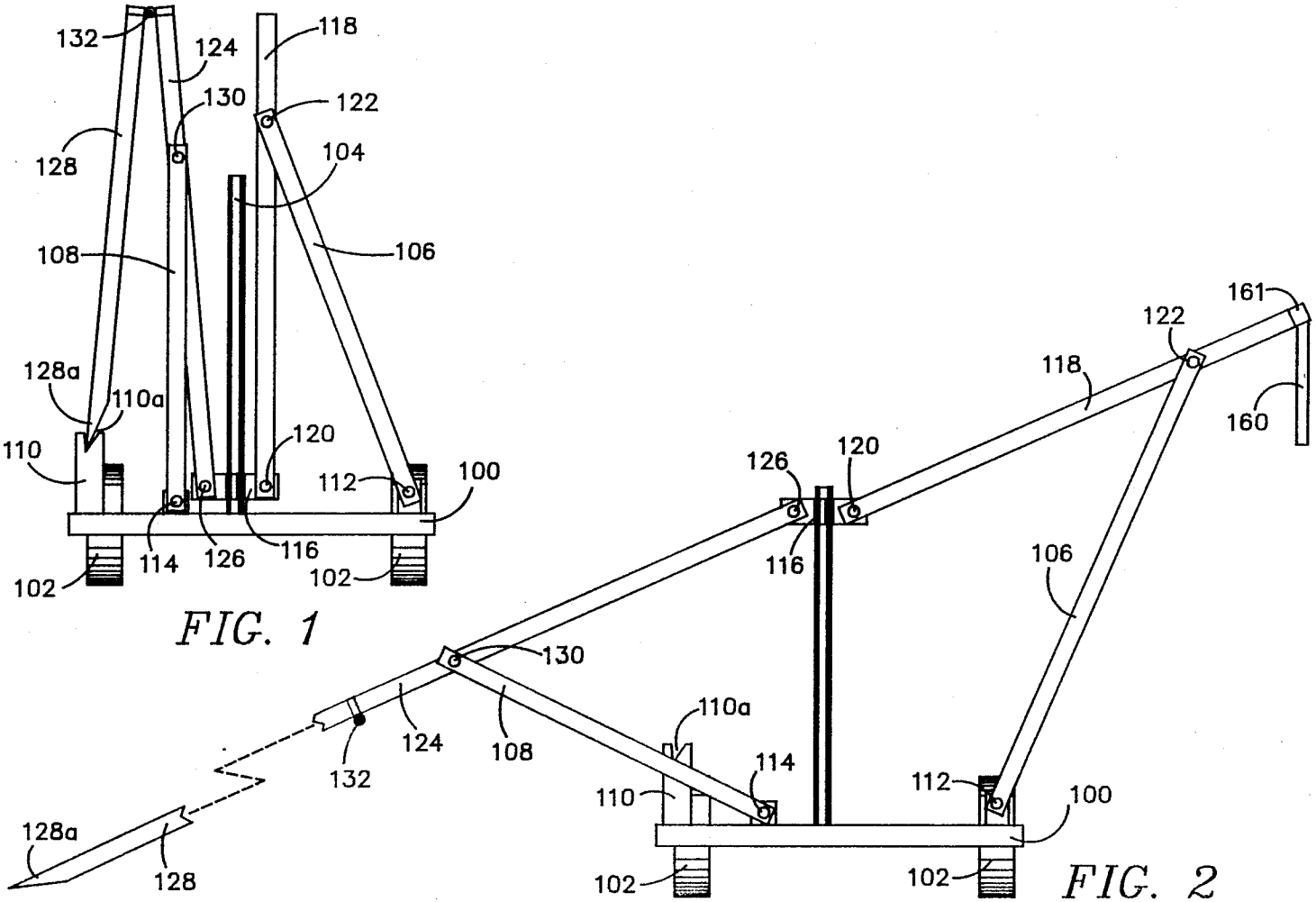
FIG. 1 is a diagram of one embodiment of the invention in a collapsed configuration.
FIG. 2 is a diagram of the embodiment of FIG. 1 in a fully expanded configuration.

DETAILED DESCRIPTION OF THE PREFERRED EMBODIMENT:

FIG. 1 is a side view of an embodiment of the portable folding game ramp of the invention particularly suitable for tennis. A base frame 100 is supported on a set of wheels 102. The base frame 100 supports a pair of center struts 104, a pair of forward articulating struts 106, a pair of middle articulating struts 108 and a pair of rear stationary struts 110. (Only one member of each of the aforementioned pairs is visible in the side view of FIG. 1.) A pair of forward hinges 112 supportingly connects the pair of forward articulating struts 106 with the base frame 100. A pair of middle hinges 114 supportingly connects the pair of middle articulating struts 108 with the base frame 100.

The pair of center struts 104 supports a pair of vertically sliding sleeves 116. One end of an articulating forward ramp 118 is connected to the pair of sleeves 116 by a first pair of sleeve hinges 120. A pair of forward hinges 122 supportingly connects the pair of forward articulating struts 106 to the forward articulating ramp 118 at intermediate points thereof as illustrated in FIG. 1.

One end of an articulating middle ramp 124 is connected to the pair of sleeves 116 by a second pair of sleeve hinges 126. A pair of middle hinges 130 supportingly connects the pair of middle articulating struts 108 to the middle articulating ramp 124 at intermediate points thereof, as illustrated in FIG. 1. The other end of the middle articulating ramp 124 is connected to one end of a rear articulating ramp 128 by a hinge 132. The other end **128*a* of the rear articulating ramp 128 rests inside a trough 110*a* in the top of each of the stationary rear struts 110** when everthe portable folding game ramp is in the folded configuration illustrated in FIG. 1. In fact, this feature holds the folding game ramp in the folded configuration of FIG. 1.

The portable folding game ramp of FIG. 1 is readily transported by rolling on the set of wheels 102 to a tennis court, where it is placed near the tennis net and unfolded into its fully expanded configuration illustrated in FIG. 2. The unfolding process is as follows: First, the tail end **128*a* of the rear articulating ramp 128 is removed from the trough 110*a* of each rear stationary strut 110 by slightly rotating the middle articulating ramp 124 about the second pair of sleeve hinges 126 clockwise in FIG. 1. Secondly, the pair of sleeves 116, which rests near the bottom of the pair of center struts 104, is raised vertically toward the top of the center struts 104 by rotating the forward ramp 118 clockwise about the first pair of sleeve hinges 120 while simultaneously rotating the intermediate ramp 124 counterclockwise about the second pair of sleeve hinges 12 in FIG. 1. This causes the pair of forward struts 106 to rotate clockwise about the pair of forward hinges 112 and the pair of middle struts 108 to rotate counterclockwise about the pair of middle hinges 114 in FIG. 1. At the same time, the rear ramp 128 should rotate clockwise about the hinge 132 so that its end 128*a* does not strike the ground until the unfolding process has reached the fully extended configuration of FIG. 2. At this point, the tail ramp end 128*a*** rests on the ground or tennis court surface, as illustrated in FIG. 2.

The forward hinges 122 are located at intermediate points along each side edge of the forward ramp 118 so that the weight of the forward ramp 118 is distributed between the sleeve hinges 120 and the forward hinges 122. Similarly, the middle hinges 130 are located at intermediate points along each side edge of the middle ramp 124 so that the combined weight of the middle ramp 124 and the rear ramp 128 is distributed between the middle hinges 130 and the sleeve hinges 126. The result is that very little force is required to carry out the unfolding process described above. The weight of the forward ramp 118 counterbalances the combined weight of the middle and rear ramps 124, 128 to at least the extent that the force required to implement the above-described unfolding process is significantly reduced. The advantage of these features is that the portable folding game ramp of the invention is readily transported on its wheels to a tennis net and is quickly unfoldable to its expanded configuration with the use of very little force.

Referring to FIG. 2, upon completion of the unfolding process, the three articulating ramps 118, 124 and 128 are coplanar and together form a single planar ramp surface rigidly supported by the base frame 100 over the set o wheels 102. Referring to the perspective view of FIG. 3, the single planar ramp surfac lies at an angle such that the highest end of the forward ramp 118 is at the same height as the top of a tennis net 140 (and is adjacent thereto) while the single planar ramp surface slopes down therefrom to the tennis court playing surface at the end **128*a* of the rear ramp 128. The bottom surface of the rampend 128*a* is oblique with respect to the top surface thereof so that the bottom surface is parallel to and rests smoothly on the playing surface in the unfolded configuration of FIG. 2. This feature makes the tail ramp end 128*a* pointed so that it neatly fits into the troughs 110*a* in the tops of the rear struts 110** in the folded configuration of FIG. 1.

A tennis ball hit toward the net 140 by a player on the same side of the net 140 as the folding game ramp will generally bounce off the single ramp surface over the net 140 instead of being arrested by the net 140 so that, in many instances, play may continue between the two players on opposing sides of the net 140.

Referring again to FIG. 3, the base frame 100, each of the struts 104, 106 and 108 and the sleeves 116 are formed of square tubing of aluminum or a lightweight alloy. Each of the wheels 102 is plastic and is supported by one of two axles 142 and 144 attached to the base frame 100. Each of the articulating ramps 118, 124 and 128 consists of a rectangular frame comprising the same square tubing mentioned above, such as the rectangular frame 150 illustrated in FIG. 3. The frame 150 supports netting 152 comprising plastic coated wire having a configuration similar to that of the strings in a regulation tennis racket.

Figure 3:
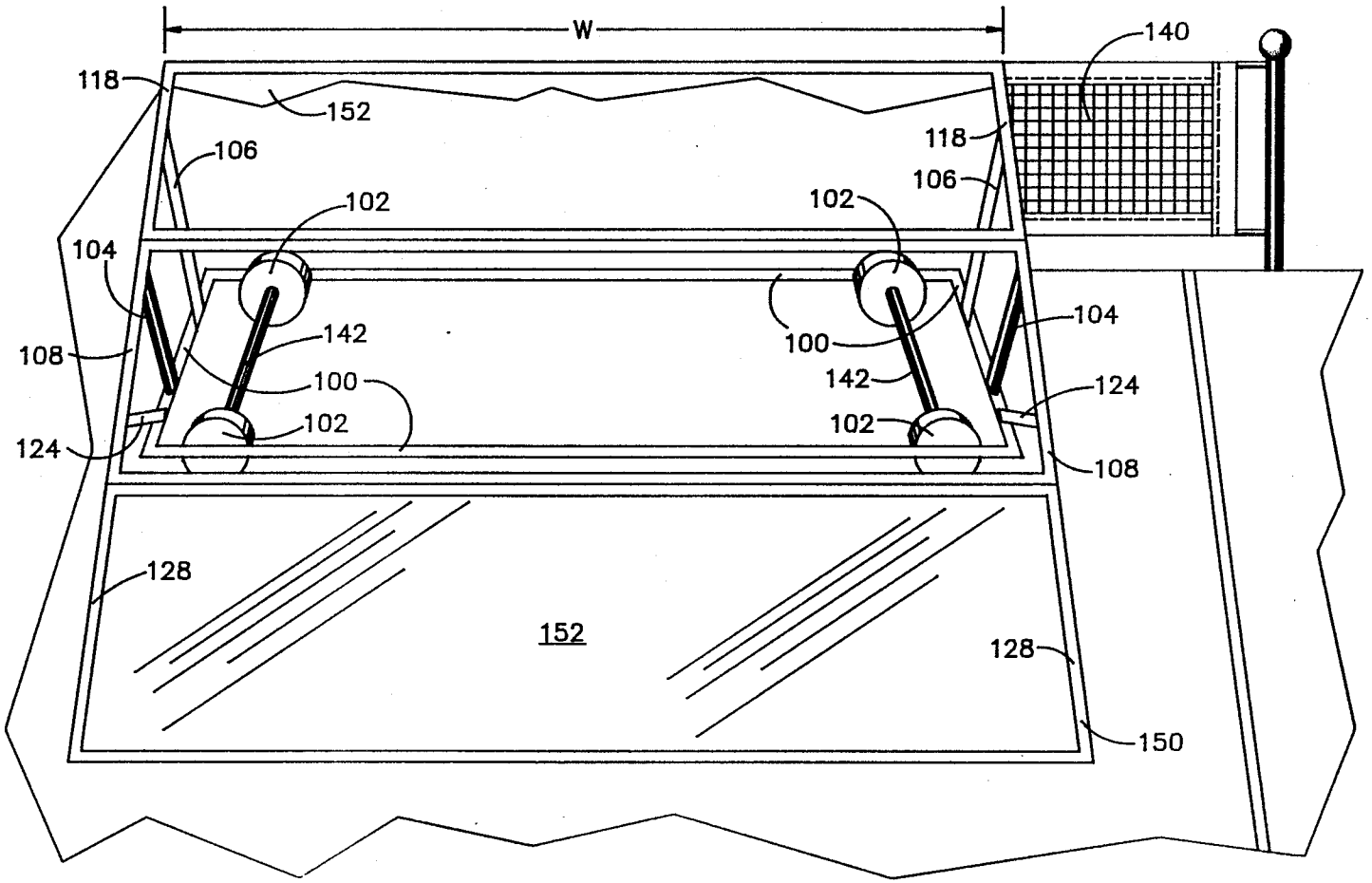
FIG. 3 is a perspective view of the embodiment of FIG. 2 illustrating its use on a tennis court.

Preferably, the folding game ramp of FIGS. 1, 2 and 3 is placed on the side of the net 140 where the lesser experienced player is stationed, thus compensating for large differences between the skill levels of the opposing players; however, it is possible to provide folding game ramps on both sides of the net 140, particularly in cases where both opposing players are rank beginners.

In the preferred embodiment, the width W (in FIG. 3) of the folding game ramp is 8 feet, thus requiring three folding game ramps to be placed side by side along the net 140 to cover the entire width of the tennis court. Referring to FIG. 2, a hanging barrier 160 extending across the entire width W is attached to the net end of the forwardramp 118 by a hinge 161, and provides a continuous barrierfrom the top of the net 140 to the top surface of the ram 118.

As those skilled in the art will readily recognize and appreciate, the invention is also useful in smaller (an non-wheeled) embodiments to enhance other net games such as ping pong (i.e., table tennis) or badminton. In ping pong, the slope of the ramp would have to be much less than that illustrated in FIG. 2 in order to accommodate the greater bounce of a ping pong ball and occupy proportionally less of the playing area. Further in the case of ping pong, it is preferable that the ramp surface be of a shock absorbing material so that the greater bounce of the ping pong ball is partially absorbed, preventing the ball from bouncing out of the playing area. For such use, the ramp could comprise a forward surface of a triangular cross-sectioned length of a suitable foam material, such as a polyfoam, or the like. In badminton, the ramp may not necessarily be linear but, rather, might be curved and might be even steeper than that illustrated in FIG. 2; and, could be confined to the top portion of the net. In badminton, the ramp could be supported on the ends by suitable brackets attached to the poles holding the badminton net on the ends thereof.

While the invention has been described in detail by specific reference to preferred embodiments thereof, it is understood that variations and modifications thereof may be made without departing from the spirit and scope of the invention.

Accordingly, having thus described my invention, I claim:

1. A portable folding game ramp in combination with a regulation lawn tennis court playing surface having a tennis net of regulation height and extending transversly there across wherein opposing players on foil playing surface propel an elastic projectile between each other over a said net of predetermined height, said portable folding game ramp comprising:

(a) a portable base frame;

(b) ramp means connected to said base frame, said ramp means characterized by a surface from which said projectile bounces upon impact therewith, said ramp means comprising, (b1) first and second planar ramp sections, each of said ramp sections having opposing pairs of longitudinal and lateral edges, (b2) center hinge means connecting said ramp sections together along a lateral edge of each of said ramp sections, (c) articulating means connecting said ramp means to said base frame whereby said ramp means is movable between a compact folded position and an extended position in which said ramp means extends from said predetermined height along a decending angle toward said playing surface.

2. The portable folding game ramp of claim 1 and further comprising:

wheel means supporting said base frame on said playing surface.

3. The portable folding game ramp of claim 1 wherein said articulating means comprises:

(a) sleeve means for constraining said center hinge means to move in a generally fixed path with respect to said base frame; and (b) articulating strut means connected to said base frame for supporting the longitudinal edges of each of said ramp sections, whereby said first and second ramp sections rotate in first opposing directions about said center hinge means toward said folded configuration as said center hinge means moves in a first direction along said path, and said ramp sections rotate in second opposing directions about said center hinge means toward said extended configuration as said center hinge means moves in the opposite direction along said path.

4. The portable folding game ramp of claim 3 and further comprising: a third ramp section and rear hinge means connecting said third ramp section along one lateral edge thereof to the other lateral edge of said second ramp section.

5. The portable folding game ramp of claim 4 and further comprising: means for constraining the other lateral edge of said (third ramp section) in said folded configuration.

6. The portable folding game ramp of claim 5 wherein:

(a) said other lateral edge of said third ramp section is characterized by a surface which is oblique relative to the other edges thereof and which terminates in a pointed edge, said oblique surface resting on and being generally coplanar with said playing surface in said extended configuration; and wherein, (b) said means for removably constraining comprises a vertical strut mounted on said base frame and characterized by a trough into which said pointed edge may be removably inserted in said folded configuration.

7. The portable folding game ramp of claim 3 wherein: said sleeve means comprises a pair of vertical center struts connected to said base frame and a pair of sleeves slidably mounted on respective ones of said center struts, said sleeves being connected to said center hinge means near opposing ends thereof.

8. The portable folding game ramp of claim 7 wherein said articulating strut means comprises:

(a) a pair of forward struts and forward hinge means connecting one end of each of said forward struts to said base frame at opposite sides thereof and connecting the other ends of said forward struts to the longitudinal edges of said first ramp section; and (b) a pair of middle struts and middle hinge means connecting one end of each of said middle struts to said base frame at opposite sides thereof and connecting the other ends of said middle struts to the longitudinal edges of said second ramp section.

9. A portable folding game ramp in combination with a regulation lawn tennis court playing surface having a regulation tennis net of regulation height and extending transversly thereacross wherein opposing players on said playing surface propel, an elastic projectile between each other over a barrier of predetermined height, said portable folding game ramp comprising:

(a) a portable base frame;

(b) a pair of connected planar ramp sections hinged together and movable between a folded configuration and an unfolded configuration in which said ramp sections form a single ramp lying in a path extending from said predetermined height toward said playing surface;

(c) means connected between said pair of ramp sections and said portable base frame for causing said pair of ramp sections to counterbalance one another.

10. The portable folding game ramp of claim 9 and further comprising:

a third ramp section hinged to an edge of one of said pair of ramp sections wherein the three ramp sections extend end to end from said predetermined height to said playing surface in said unfolded configuration.

11. The portable folding game ramp of claim 9 wherein:

each of said ramp sections is characterized by a top surface for reflecting the trajectory of an incident projectile.

12. A play equalizing ramp in combination with a tennis court playing surface having a regulation tennis net of regulation height and extending transversly there across wherein opposing players of different degrees of expertese propel an elastic projectile between each other over said net disposed vertically above a playing surface, said play equalizing ramp comprising:

(a) projectile deflecting ramp means extending downward from a top edge of said net towards the one of the players which is of less expertese and including a reflecting top surface for deflecting the projectile from a trajectory which would carry it into said net to a trajectory carrying it over said net, said ramp means comprising at least two rectangular ramp sections hingedly connected together at horizontal hinge points whereby said ramp sections can be folded together for storage; and (b) support means for supporting said ramp means in said position extending downward from said top edge of said net towards said one of the players.

13. The play equalizing ramp of claim 12 wherein:

(a) said support means comprises, (a1) a flat base section mounted on wheels which roll on the playing surface for moving the equalizing ramp between a location adjacent said net for use in game play and a storage location, and (a2) an upright section carried by said base section;

(b) gripping means carried by said base section for gripping portions of said ramp sections; and wherein (c) said ramp sections are pivotally attached to said upright section for pivoting movement between a playing position with said ramp sections coplanar to form said ramp means extending from the top of the barrier to and resting on the playing surface and a storage position with said ramp sections folded together and with portions of said ramp sections being gripped and retained in said storage position by said gripping means.

14. The play equalizing ramp of claim 13 and additionally comprising:

a plurality of support struts pivotally connected between said base section and ones of said ramp sections for rigidly supporting said ramp means in said playing position.

15. The play equalizing ramp of claim 12 and additionally comprising:

a lip member extending downward from said ramp means from the top of said net along and parallel to said net on the side of the barrier opposite said ramp means.

* * * * *